United States Patent [19]

Brown et al.

[11] 4,044,322

[45] Aug. 23, 1977

[54] ELECTROMAGNETIC SOLENOID RELAY ASSEMBLY AND ELECTRICAL CONNECTION MEANS THEREFOR

[75] Inventors: Samuel J. Brown, South Lyon; Gideon A. DuRocher, Mount Clemens; Gerald L. McClure, Warren, all of Mich.

[73] Assignee: Essex Group, Inc., Fort Wayne, Ind.

[21] Appl. No.: 703,888

[22] Filed: July 9, 1976

[51] Int. Cl.[2] ..... H01H 67/02

[52] U.S. Cl. ..... 335/131; 335/133; 200/264

[58] Field of Search ..... 335/131, 133, 196, 255; 200/264, 265

[56] References Cited

U.S. PATENT DOCUMENTS

| | | | |
|---|---|---|---|
| 3,784,941 | 1/1974 | DuRocher | 335/196 |
| Re. 28,595 | 10/1975 | DuRocher | 200/265 |

FOREIGN PATENT DOCUMENTS

| | | | |
|---|---|---|---|
| 1,183,578 | 3/1970 | United Kingdom | 335/202 |

*Primary Examiner*—George Harris

*Attorney, Agent, or Firm*—Lawrence E. Freiburger; Robert D. Sommer

[57] ABSTRACT

An electromagnetic solenoid relay assembly in which all the electrical connections are located on one end thereof. The solenoid relay assembly of the invention is attached to a printed circuit board by a spring clip member. The relay assembly of the invention includes a bobbin with an electromagnetic coil wound thereon, a stationary core located in the bore of the bobbin, and a movable core slidably located in the bore which is attracted to the stationary core when the electromagnetic coil is energized. An electrical contact is located on the opposing faces of the stationary and movable core members such that an electrical circuit through the two is completed when the coil is energized. A bias force on the movable core member is provided by a spring which urges the movable core away from the stationary core. A pressure plate member carrying a plurality of electrical contacts thereon makes electrical contact to the spring which, in turn, is electrically connected to the contact on the movable core member. The electrical connection to the contact on the stationary core member is made by a bus bar which is connected to the contact at one end and a contact on the insulative member at the other end.

4 Claims, 6 Drawing Figures

ELECTROMAGNETIC SOLENOID RELAY ASSEMBLY AND ELECTRICAL CONNECTION MEANS THEREFOR

BACKGROUND OF THE INVENTION

In the prior art, solenoid type relays are known which are adapted to be fastened to a printed circuit board and in which two movable plunger armatures carry their respective contacts into engagement when the coil is energized. Also known in the prior art is a solenoid relay in which a contact carried on the pole face of a stationary core member mates with a contact carried by a movable armature. In this solenoid relay structure, a spring disc supports and biases the armature for movement toward and away from the stationary core.

It is also known in the prior art to use a spring clip to secure a relay or other device on a printed circuit board.

Because printed circuits have generally been used in situations where space is a prime consideration, electromagnetic relays have not widely been mounted on printed circuits because of their size. Small relays have been developed specifically for the purpose of mounting on printed circuit boards. However, these relays suffer from the drawback that their current carrying capacity is somewhat less than desirable or the printed circuit board mounting is complicated and/or unreliable.

SUMMARY OF THE INVENTION

Thus, it is an object of the present invention to provide a reliable relay for mounting on printed circuit boards which has a high current carrying capacity relative to its overall size. It is a further object of the invention to provide a simple, yet reliable, electrical connector for electrically connecting a relay to a printed circuit board.

The above-noted objects of the invention, as well as others which will become more apparent as the description of the invention proceeds, are accomplished by the solenoid type relay structure of the present invention. In accordance with the present invention, a solenoid type relay includes an electromagnetic coil wound upon a spool-like bobbin which has an axial bore therein. A stationary core member occupies one end of the bore for movement toward and away from the stationary core member. The opposing faces of the core members each carry an electrical contact such that an electrical circuit is completed when the two come into contact. A pressure plate secured to the end flange of the bobbin adjacent the movable core member cooperates with the bobbin to hold a leaf spring in place. The leaf spring acts to bias the movable core member away from the stationary core member. Electrical connections to the contact on the movable core member are made through the leaf spring which is electrically connected to a terminal on the pressure plate. The other electrical connections including the coil connections and the connection to the contact on the stationary core member are also made through the terminals on the pressure plate.

The solenoid relay structure of the present invention advantageously locates the main current carrying contacts in the highest density magnetic flux field available. By locating the main current carrying contacts in the high density flux field, the well-known magnetic blowout effect is advantageously utilized to provide increased current carrying capacity.

BRIEF DESCRIPTION OF THE DRAWINGS

In the course of the detailed description of the invention, reference will be made to the drawings in which.

DETAILED DESCRIPTION OF THE INVENTION

Figure 2:
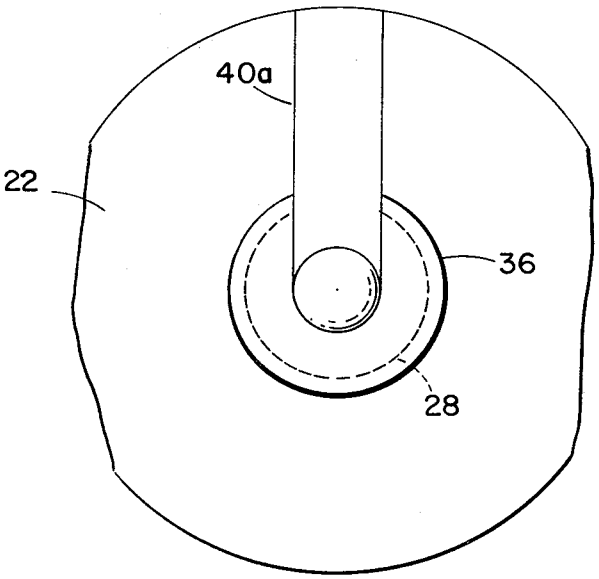
FIG. 2 is an end elevational view of the solenoid relay of FIG. 1 with the casing removed.
Figure 1:
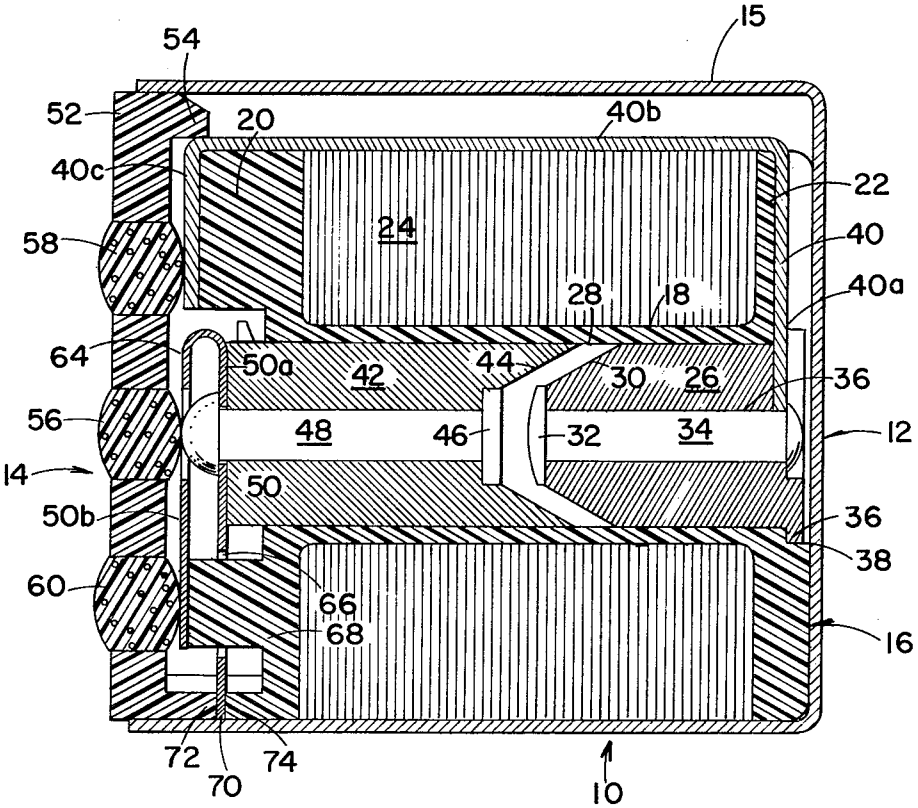
FIG. 1 is a longitudinal cross sectional view of a solenoid type relay of the present invention.
Figure 3:
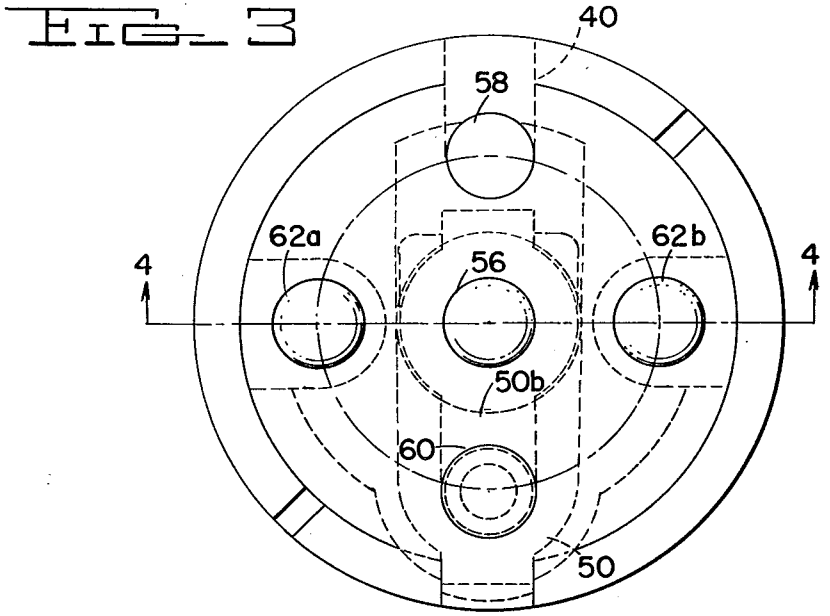
FIG. 3 is an elevational view of the other end of the solenoid relay of FIG. 1.

Referring now to the drawing FIGURES, a solenoid type in accordance with the present invention includes an electromagnetic coil assembly 10, a magnetic core assembly 12, an electrical connector assembly 14, and a casing 15.

The electromagnetic coil assembly 10 includes a spool-like bobbin 16 which has a central tubular portion 18 and circular end flanges 20, 22 attached to opposite ends of tubular portion 18. The bobbin 16 forms a holder for a plurality of turns 24 of magnet type wire.

The magnetic core assembly includes a stationary core 26 situated in the right end of bore 28 in tubular portion 18. The interior end of stationary core member 26 is tapered outwardly as at 30. An electrical contact member including an integral head 32 and shaft 34 is situated with shaft 34 occupying an axial bore 36 in stationary core member 26. Stationary core 26 is prevented from moving axially into bore 28 by a tab 36 which cooperates with a corresponding notch 38 in end flange 22. Shaft 34 extends through an aperture in a flat strip-like electrical conductor 40 and its end is peened over at 42. The electrical conductor 40 performs the two-fold function of maintaining stationary core member 26 in place and making an electrical connection to electrical contact 32. It will be seen that electrical conductor 40 includes a portion **40*a* which lies flat against flange 22 and which is mechanically and electrically attached to shaft 34, portion 40*b* which extends longitudinally along the outside of electromagnetic coil assembly 10 and portion 40*c* which extends along flange 20 generally parallel to portion 40*a***.

The magnetic core assembly 12 also includes a movable core member 42 situated in bore 28 for slidable movement toward and away from the stationary core member 26. The interior end of movable core member is tapered at 44 so as to complement the taper 30 on core member 26. An electrical contact member including an integral head 46 and shaft 48 is attached to core member 42 with head 46 located so as to contact head 32. A leaf spring member 50 is attached to movable core member 42 by peening over the end shaft 48. The leaf spring 50 serves the dual function of biasing movable core 42 away from the stationary core 26 and making electrical contact to electrical contact 46.

The electrical connector assembly 14 includes a rigid insulative plate 52 which is adapted to be attached to flange 20. Preferably, the plate 52 is attached to flange 20 by frictional means such as plurality of tabs 54 spaced around the periphery thereof which frictionally engage the flange 20 or electrical conductor 40. However, it will be appreciated by those skilled in the art that the plate 52 may be attached to the flange 20 by any suitable means. Pressure plate 52 has a plurality of spaced apart, electrically conductive, resilient pads 56, 58, 60, 62*a* and 62*b* located therein. Each electrically conductive pad comprises a molded, resilient, compressible, dielectric substance, such as silicone rubber, and throughout which a plurality of discrete, electrically conductive particles are dispersed. The size and quantity of the particles are such that they may establish electrically conductive paths through the pads. The pads 56, 58, 60, 62*a* and 62*b* are thicker than plate 52 so as to project beyond the sides of the latter and are either bonded after molding to the edges of the openings in the plate 52 or are adhered thereto by being molded in situ. The structural and electrical characteristics of the pads and the manner in which they are formed are disclosed in U.S. Pat. No. 3,648,002 to which reference may be had for a more detailed description.

It will be appreciated that whenever pressure plate 52 is clipped onto flange 20, electrically conductive pad 58 will make electrical contact to portion 40*c* of conductor 40, conductive pad 60 makes electrical contact to portion 50*b* of leaf spring 50, and conductive pad 56 makes electrical contact to the peened over end of shaft 48 through an aperture 64 in spring portion 50*b* (only when movable core member 42 is in the deenergized position).

Pressure plate 52 also cooperates with bobbin flange 20 in such a manner as to provide a mounting for leaf spring 50. An aperture 66 in leg 50*a* of leaf spring 50 fits over a boss 68 on flange 20 and the end 70 of leaf spring 50 is entrapped between an inwardly extending flange 72 on pressure plate 52 and an outwardly extending flange 74 on flange 20. Boss 68 also serves to entrap the end of spring leg 50*b* between it and resilient contact 60 when pressure plate 52 is mounted on bobbin flange 20.

Figure 4:
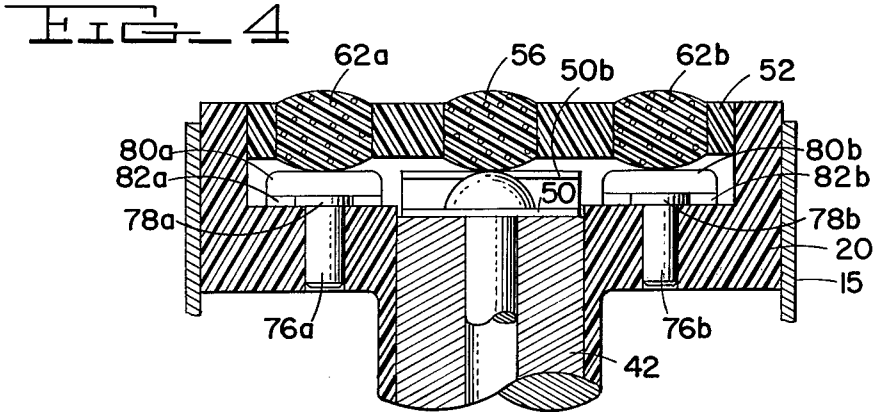
FIG. 4 is a cross sectional view taken along lines 4—4 of FIG. 3.

Referring now to FIG. 4, electrical connections to the electromagnetic coil leads (not shown) are made through resilient contacts 62*a* and 62*b* which abut against the head of contact pins 76*a* and 76*b* respectively. Contact pins 76*a* and 76*b* include a shaft portion which is frictionally engaged in an aperture in the end flange 20. The contact pins 76*a* and 76*b* each also include: an intermediate portions 78*a* and 78*b,* and a head 80*a* and 80*b,* respectively. Surrounding the intermediate portions 78*a* and 78*b* and located between the contact pin head and the portion of flange 20 thereunder is a resilient compressible, electrically conductive washer 82*a, 82*b* formed of similar or the same material as contact pads 56, 58, 60, 62*a* and 62*b.* With the construction shown in FIG. 4, the electromagnetic coil leads are stripped of electrical insulation, are placed around the intermediate portion 78*a, 78*b* along with the contact washer 82*a, 82*b* and the contact pins are inserted and retained in the apertures in flange 20. When the pressure plate 52 is assembled to the bobbin flange 20, it will be appreciated that contact pads 62*a* and 62*b* will make electrical contact to the heads 80*a, 80*b* of contact pins and, of course, the electromagnetic coil leads which are electrically connected to the contact pins.

The casing 15 is generally cup shaped metal member inside which the solenoid type relay assembly is situated. Preferably, the casing frictionally engages the outer periphery of the pressure plate member 52 and/or the periphery of the electromagnetic coil assembly.

Figure 5:
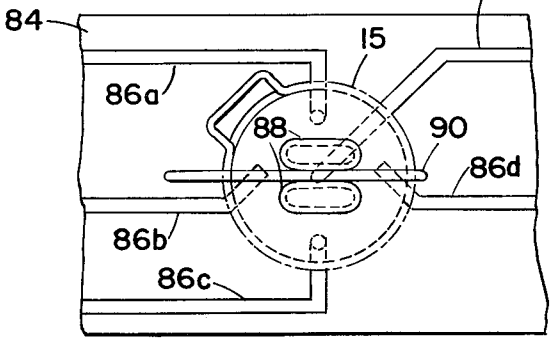
FIG. 5 is a top elevational view of the relay assembly of the invention mounted on a printed circuit board.
Figure 6:
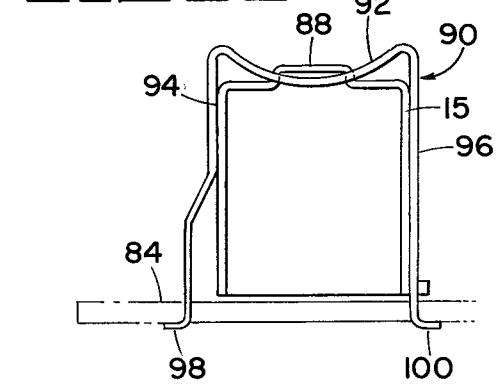
FIG. 6 is a front elevational view of the relay-printed circuit board assembly of FIG. 5.

Referring now to FIGS. 5 and 6, the solenoid relay assembly of the invention is shown in position mounted on a printed circuit board 84. The printed circuit board 84 has a plurality of spaced apart electrically conductive strips 86*a, 86*b, 86*d* and 86*e* which are arranged in such a manner that they terminate in a pattern identical to the pattern of the electrically conductive pads 56, 58, 60, 62*a* and 62*b* on the pressure plate. In mounting the solenoid relay assembly of the invention on the printed circuit board, electrically conductive pad 56 is placed in face-to-face contact with conductive strip 86*e,* conductive pads 58 and 60 make face-to-face electrical contact with conductive strips 86*a* and 86*c,* and conductive pads 62*a* and 62*b* make face to face electrical contact with conductive strips 86*b* and 86*d.*

Casing member 15 has two parallel ribs 88 formed in the end thereof which define an indentation therebetween and which provides a locating position for a spring clip 90. Spring clip 90 includes an arcuate spring portion 92 and mounting legs 94 and 96 which are adapted to extend through apertures in the printed circuit board. The ends 98 and 100 of mounting legs 94, 96, respectively, are bent over to permanently attach the relay to printed circuit board.

It will be appreciated by those skilled in the art that the above-described relay structure is compact and, thus, is particularly adaptable to mounting on printed circuits. Further, by mounting the main electrical contacts on the core members in the high density flux field, the magnetic blowout effect is utilized to its greatest advantage in such a manner to increase the current carrying capability.

Of course, obvious modifications will occur to those skilled in the art. One such modification which is contemplated by the present invention is replacing the main current carrying contacts (which in the preferred embodiment of the invention are formed from conventional contact material) with contacts of similar material to the ones located on the pressure plate 52. The appended claims define the invention.

What is claimed is:

1. An electromagnetic solenoid relay assembly comprising:

an electromagnetic coil assembly including a spool-like bobbin having a bore extending axially therethrough, first and second end flanges on said bobbin, and an electromagnetic coil wound upon said bobbin;

a stationary core member occupying a first end of said bore and secured to said bobbin;

a movable core member slidably located in said bore for movement toward and away from said stationary core member;

electrical contacts on the opposing faces of said stationary and movable cores;

an insulative pressure plate attached to said second end flange, said pressure plate having a plurality of spaced apart electrical contacts located thereon;

spring means for biasing said movable core away from said stationary core;

electrically conductive means for electrically connecting the contact on said stationary core member with one of the electrical contacts on said insulative pressure plate;

said spring means being electrically connected to another one of the electrical contacts on said insulative pressure plate;

electrically conductive means connecting said spring means with the electrical contact on said movable core member; and the leads of said electromagnetic coil being connected to electrical contacts on said insulative pressure plate.

2. The relay assembly as claimed in claim 1 wherein: said spaced apart electrical contacts on said insulative pressure plate each comprise a resilient, deformable, elastomeric pad having a plurality of discrete electrically conductive particles dispersed therein, said pad extending through said pressure plate slightly beyond the faces thereof.

3. The relay assembly as claimed in claim 1 wherein said electrically conductive means for electrically connecting the contact on said stationary core member with one of the electrical contacts on said insulative pressure plate comprises:

an electrically conductive shaft integral with said contact and extending axially through said stationary core;

a strip-like electrical conductor connected to said shaft, said strip like electrical conductor extending around said electromagnetic coil assembly, the free end of said strip like electrical conductor being entrapped between said one of said electrical contacts and said second end flange.

4. The relay assembly as claimed in claim 1 wherein said electrically conductive means connecting said spring means with the electrical contact on said movable core member comprises:

an electrically conductive shaft integral with said contact and extending axially through said movable core member;

said conductive shaft being secured to said spring means.

* * * * *